US007101659B1

(12) United States Patent
Zengerle et al.

(10) Patent No.: US 7,101,659 B1
(45) Date of Patent: Sep. 5, 2006

(54) COLOR PHOTOGRAPHIC ELEMENT WITH UV ABSORBER

(75) Inventors: Paul L. Zengerle, Rochester, NY (US); Kurt M. Schroeder, Spencerport, NY (US); Rebecca A. Ott, Rochester, NY (US); Efrain O. Morales, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/174,306

(22) Filed: Jul. 1, 2005

(51) Int. Cl.

| | |
|---|---|
| ***G03C 1/46*** | (2006.01) |
| ***G03C 1/85*** | (2006.01) |
| ***G03C 1/815*** | (2006.01) |
| ***G03C 1/825*** | (2006.01) |

(52) U.S. Cl. ..... 430/502; 430/507; 430/512; 430/931; 430/523; 430/527

(58) Field of Classification Search ..... 430/502, 430/507, 512, 931, 523, 527
See application file for complete search history.

(56) References Cited

U.S. PATENT DOCUMENTS

| | | | | |
|---|---|---|---|---|
| 3,813,255 | A | 5/1974 | Mannens et al. | |
| 4,387,089 | A | 6/1983 | De Polo | |
| 4,611,061 | A | 9/1986 | Beard et al. | |
| 5,385,815 | A | 1/1995 | Schofield et al. | |
| 5,460,928 | A | 10/1995 | Kam-Ng et al. | |
| 5,474,887 | A | 12/1995 | Reed et al. | |
| 5,783,178 | A | 7/1998 | Kabanov et al. | |
| 5,786,133 | A * | 7/1998 | Smith | 430/512 |
| 5,788,954 | A | 8/1998 | Bonda et al. | |
| 5,849,273 | A | 12/1998 | Bonda et al. | |
| 5,993,789 | A | 11/1999 | Bonda et al. | |
| 6,129,909 | A | 10/2000 | Bonda et al. | |
| 6,143,484 | A | 11/2000 | Schroeder et al. | |
| 6,225,037 | B1 | 5/2001 | Buitano et al. | |
| 6,509,144 | B1 | 1/2003 | Reed et al. | |
| 6,767,937 | B1 | 7/2004 | Schunk et al. | |
| 6,811,963 | B1 | 11/2004 | Johnston et al. | |
| 6,815,153 | B1 | 11/2004 | Friday et al. | |
| 6,872,766 | B1 | 3/2005 | Schunk et al. | |
| 2004/0137386 | A1 | 7/2004 | Yokota et al. | |

FOREIGN PATENT DOCUMENTS

| | | |
|---|---|---|
| EP | 0 057 160 | 6/1985 |
| EP | 0 190 003 | 9/1991 |
| JP | 4-213348 | 8/1992 |

OTHER PUBLICATIONS

S. K. Wu et al; "A Study Of The Photo-Stabilizing Behaviors of β-Diketones"; Polymer Degradation And Stability; 16; 1986; pp. 169-186.

U.S. Appl. No. 10/896,108, filed Jul. 21, 2004; of Robert E. Dickerson et al; titled "Photothermographic Materials With UV Absorbing Compounds".

* cited by examiner

*Primary Examiner*—Geraldine Letscher
(74) *Attorney, Agent, or Firm*—Andrew J. Anderson

(57) ABSTRACT

A photographic element is described comprising a support bearing at least one blue light sensitive silver halide emulsion layer and an ultraviolet filter layer above the light sensitive layer, wherein the ultraviolet filter layer comprises an ultraviolet absorbing dibenzoylmethane compound of formula (I)

where R1 through R5 are each independently hydrogen, halogen, nitro, or hydroyxl, or further substituted or unsubstituted alkyl, alkenyl, aryl, alkoxy, acyloxy, ester, carboxyl, alkyl thio, aryl thio, alkyl amine, aryl amine, alkyl nitrile, aryl nitrile, arylsulfonyl, or 5–6 member heterocycle ring groups. The present invention describes photographic elements that include materials that deliver a preferred UV absorption spectrum that provides adequate spark protection, and minimizes UV radiation incident on the element during camera exposure so that accurate color rendition can be achieved, while maximizing photographic speed in the blue record.

7 Claims, 1 Drawing Sheet

COLOR PHOTOGRAPHIC ELEMENT WITH UV ABSORBER

FIELD OF THE INVENTION

This invention relates to a silver halide photographic material containing materials that absorb ultraviolet (UV) radiation. The invention is directed in particular to a color photographic material with high blue light sensitivity.

BACKGROUND OF THE INVENTION

In color photographic materials, silver halide emulsions are employed which are sensitized to specific regions of the visible spectrum commonly referred to as: the blue region (400–500 nm), green region (500–600 nm), and red region (600–700 nm), using different chemical sensitizing dyes that are adsorbed to the surface of the silver halide emulsion grains. Color negative photographic films are usually designed to record complementary color images using separate emulsion layers that have distinct sensitivities to various regions of the visible spectrum. For example, color photographic elements are conventionally formed with superimposed blue, green, and red recording layer units coated on a support. The blue, green, and red recording layer units contain radiation-sensitive silver halide emulsions that form a latent image in response to blue, green, and red light, respectively. Additionally, the blue recording layer unit typically contains a yellow dye-forming coupler, the green recording layer unit typically contains a magenta dye-forming coupler, and the red recording layer unit typically contains a cyan dye-forming coupler. However, in addition to their desired light sensitivity, these emulsions also have an inherent sensitivity to UV radiation. In order to achieve accurate color reproduction, it is generally desired that only visible light be incident on the photosensitive emulsion layers during camera exposure.

The blue sensitivity of a multilayer film element is determined by the light absorption profile of the silver halide emulsions in the blue sensitive layer unit attenuated by any ultraviolet light absorbing materials that lie above it in the top layers of the film, such as ultraviolet filter dyes, Lippmann emulsions, and polymeric beads used to reduce friction in the top layers of the film. The light absorption of the emulsions used in the blue sensitive layer unit is in turn determined by the composite absorption of the specific combination of spectral sensitizing dyes adsorbed to the surface of the silver halide grains and the intrinsic blue light absorption of silver bromide and silver iodide.

Conventional non-tabular silver (iodo)bromide emulsions having grains which are primarily cubic, octahedral, cubo-octahedral or polymorphic in shape typically have an inherent sensitivity to visible light in the region of about 400–430 nm, and accordingly may be used in a blue recording layer unit with or without spectral sensitizing dyes. Tabular grain emulsions are also known for use in the blue sensitive layer of color negative film elements. Tabular grains, when present in the blue sensitive layer, result in improved transmission of incident light to underlying green and red sensitive layers. In order to provide practical photographic efficiency, however, such grains typically need to be sensitized in the blue region by a spectral dyeing technique to yield blue sensitive emulsions, as high tabularity, low bulk iodide tabular grains have relatively little inherent sensitivity in the 400–500 nm range. By spectrally sensitizing these emulsions where there exists a higher number of photons per unit energy (that is, between 450–480 nm of the blue region), the sensitivity and hence the efficiency of the blue sensitive record containing these elements is maximized. Optionally, a blue sensitizing dye, or combination of dyes, can also be used with conventional nontabular grains to provide sensitivity to the 430–500 nm region of the visible spectrum. Silver halide grains employed in green and red light recording layers, whether tabular or non-tabular, require sensitizing dyes on the emulsion grains to sensitize them to the required red and green region of the spectrum.

Following imagewise exposure, a negative working photographic element is processed in a color developer that contains a color developing agent that is oxidized while selectively reducing to silver the latent image bearing silver halide grains. The oxidized color developing agent then reacts with the dyeforming coupler in the vicinity of the developed grains to produce an image dye. Yellow (blue-absorbing), magenta (green-absorbing) and cyan (red-absorbing) image dyes are formed in the blue, green, and red recording layer units, respectively. Subsequently the element is bleached (i.e., developed silver is converted back to silver halide) to eliminate neutral density attributable to developed silver and then fixed (i.e., silver halide is removed) to provide stability during subsequent room light handling.

When processing is conducted as noted above, negative dye images are produced. To produce corresponding positive dye images, and hence, to produce a visual approximation of the hues of the subject photographed, white light is typically passed through the color negative image to expose a second color photographic material having blue, green, and red recording layer units as described above, usually coated on a white reflective support. The second element is commonly referred to as a color print element. Processing of the color print element as described above produces a viewable positive image that approximates that of the subject originally photographed.

UV absorbing materials are commonly used in color photographic film products. The preparation and use of UV absorbers has been described in U.S. Pat. Nos. 3,813,255, 4,611,061, and 5,385,815 and European Published Applications 0,057,160 and 0,190,003. They are usually located in layers above and below the light-sensitive emulsion layers. UV absorbers are used below the emulsion layers to prevent static marking from the base side due to exposure from electrical discharge that may be generated during the winding and unwinding of rolled film during manufacturing (both sensitizing and finishing) operations or during mechanical winding and unwinding inside a film camera or during film processing.

The UV region of the electromagnetic spectrum is approximately 200 to 400 nanometers. Since any electrical discharge would take place in air, which is mostly nitrogen, the spectral emission of a "spark" is characteristic of nitrogen, and has strong bands in the 300–400 nm region of the spectrum. UV absorbers are also coated above the emulsion layers for spark protection from the front side as previously described and to prevent UV radiation from striking the emulsion layers during camera lens exposure, as UV radiation reflected from a photographic subject or scene may interfere with the accurate reproduction of color in the finished print.

In choosing materials to be used as UV absorbers above the emulsion layers, it is generally desired that they have a strong absorption throughout the longer UV region (300–400 nm) with little or no absorption in the visible region (400–700 nm). If the absorption of the material does not extend throughout the UV region, then exposure of the emulsions to UV light may adversely impact color reproduction. If the absorption of the material extends too far into the visible region (e.g., >400 nm), on the other hand, then light sensitivity (photographic speed) of the photographic element in the blue region of the spectrum will be reduced. Hence, the ideal UV absorber would absorb sufficient UV radiation to prevent color reproduction error, while minimizing absorption of visible light. It is also desirable to use materials that are inexpensive and have a high extinction coefficient (UV absorbing power) so that low amounts of material may be employed.

There are many organic compounds available that absorb UV radiation at shorter wavelengths (<about 370 nm), but many of these have low extinction coefficients, requiring them to be used at high levels in the coated layers to provide adequate protection. The use of these materials alone with insufficient absorption at longer wavelengths results in two problems. First of all, the spark sensitivity may be too high. Secondly, too much UV radiation would be incident on the emulsion layers, resulting in inaccurate color reproduction.

There are also many organic materials that absorb UV at longer wavelengths, but most of these materials have absorptions that extend significantly into the visible region of the spectrum. These materials generally provide adequate UV protection, but they reduce the light sensitivity of the photographic element in the blue region. This results in lower effective photographic speed, requiring coating higher levels of blue-sensitive silver halide emulsion, which results in undesirably higher material costs.

Dibenzoylmethane ultraviolet absorbing compounds are known in the art for their use as UV light blockers in cosmetic sunscreens as described in, e.g., U.S. Pat. Nos. 4,387,089; 5,783,178; 5,849,273; 5,788,954; 5,993,789; and 6,129,909. Additionally, Wu et. al "A Study of the Photo-stabilizing Behaviors of β-Diketones," Polymer Degradation Stability, (16) 1986, 169–186 discloses the use of dibenzoylmethane derivatives as UV exposure stabilizers for viscosity retention of polybutadiene solutions. Further, Japanese Kokai JP 04213348 A2 discloses the use of a dibenzoylmethane derivative to improve the weatherability of an acrylic resin film by incorporating the UV absorber inside of cross-linked polymer particles that are dispersed in the resin film to reduce migration out of the film. U.S. Pat. Nos. 6,872,766 and 6,767,937 teach the use of mixtures of dibenzoylmethane and other ultraviolet ray absorbing compounds molecularly dispersed within a polymeric film such as those fabricated into polarizers for use in displays. Dibenzoylmethane derivatives are also contemplated as antihalation agents in photothermographic imaging elements as disclosed in copending, commonly assigned U.S. Ser. No. 10/896,108 filed Jul. 21, 2004. Such compounds have not been previously suggested, however, for use in an ultraviolet filter layer coated above a silver halide emulsion layer in a photographic element.

SUMMARY OF THE INVENTION

In accordance with one embodiment of the invention, a photographic element is described comprising a support bearing at least one blue light sensitive silver halide emulsion layer and an ultraviolet filter layer above the light sensitive layer, wherein the ultraviolet filter layer comprises an ultraviolet absorbing dibenzoylmethane compound of formula (I)

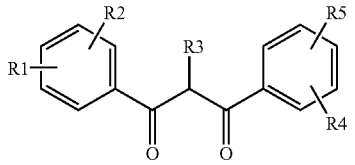

where R1 through R5 are each independently hydrogen, halogen, nitro, or hydroyxl, or further substituted or unsubstituted alkyl, alkenyl, aryl, alkoxy, acyloxy, ester, carboxyl, alkyl thio, aryl thio, alkyl amine, aryl amine, alkyl nitrile, aryl nitrile, arylsulfonyl, or 5–6 member heterocycle ring groups. The present invention describes photographic elements that include materials that deliver a preferred UV absorption spectrum that provides adequate spark protection, and minimizes UV radiation incident on the element during camera exposure so that accurate color rendition can be achieved, while maximizing photographic speed in the blue record.

DETAILED DESCRIPTION OF THE INVENTION

Figure 1:
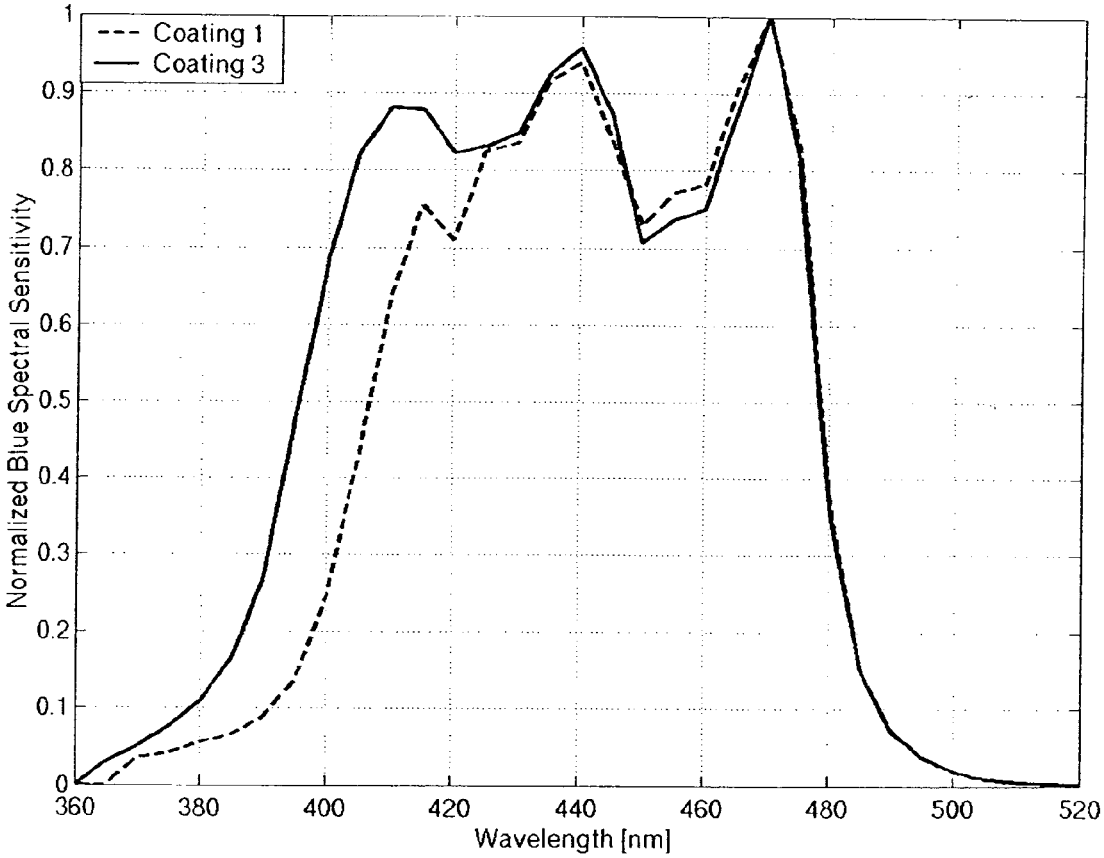
FIG. 1 is a graph showing blue spectral sensitivities for Coatings 1 and 3 of Example 1.

The invention is directed towards use of an ultraviolet absorbing dibenzoylmethane compound of formula (I) in a photographic element generally as described above. Dibenzoylmethane ultraviolet absorbing compounds of formula (I) are themselves known, as described, e.g., in above referenced U.S. Pat. Nos. 4,387,089; 5,783,178; 5,849,273; 5,788,954; 5,993,789; and 6,129,909; Wu et. al "A Study of the Photo-stabilizing Behaviors of β-Diketones," Polymer Degradation Stability", (16) 1986, 169–186; Japanese Kokai JP 04213348 A2; and U.S. Pat. Nos. 6,872,766 and 6,767,937, the disclosures of which are hereby incorporated by reference.

In Formula (I), each of R1 through R5 independently represents hydrogen, halogen, nitro, or hydroyxl, or further substituted or unsubstituted alkyl, alkenyl, aryl, alkoxy, acyloxy, ester, carboxy, alkyl thio, aryl thio, alkyl amine, aryl amine, alkyl nitrile, aryl nitrile, arylsulfonyl, or 5–6 member heterocycle ring groups. Preferably, each of such groups comprises 20 or fewer carbon atoms. Further preferably, R1 through R5 of Formula I are positioned in accordance with Formula I-A:

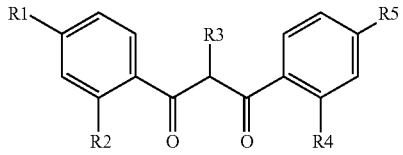

Particularly preferred are compounds of Formula I-A where R1 and R5 represent alkyl or alkoxy groups of from 1–6 carbon atoms and R2 through R4 represent hydrogen atoms.

Representative compounds of Formula (I) which may be employed in accordance with the invention include the following:

(I-1): 4-(1,1-dimethylethyl)-4'-methoxydibenzoylmethane (PARSOL 1789)

(I-2): 4-isopropyl dibenzoylmethane (EUSOLEX 8020)

(I-3): dibenzoylmethane (RHODIASTAB 83)

The present inventors have observed that dibenzoylmethane derivatives of Formula I have been found to advantageously provide a sharp cut off in absorption between the long UV and visible light ranges when employed in a filter layer above a light-sensitive emulsion in a photographic element, thereby minimizing long UV radiation incident on the underlying emulsion of the photographic element during camera exposure so that accurate color rendition can be achieved, while still allowing short blue radiation exposure of the element, maximizing photographic speed.

The photographic elements of the invention can be single color elements, including black and white elements, or multicolor elements. Multicolor elements contain image dye-forming units sensitive to each of the three primary regions of the spectrum. Each unit can comprise a single emulsion layer or multiple emulsion layers sensitive to a given region of the spectrum, such as two or more layers of differing sensitivities, including various combinations of layers having fast, intermediate or slow sensitivities. There may be more than one fast, slow or intermediate layer. The layers of the element, including the layers of the image-forming units, can be arranged in various orders as known in the art. In an alternative format, the emulsions sensitive to each of the three primary regions of the spectrum can be disposed as a single segmented layer.

While not limited thereto, in preferred embodiments the invention is directed towards color silver halide photographic element comprising a support bearing a red light recording unit comprised of at least one red-sensitive silver halide emulsion layer having associated therewith at least one cyan dye-forming coupler, a green light recording unit comprising at least one green-sensitive silver halide emulsion layer having associated therewith at least one magenta dye-forming coupler, and a blue light recording unit comprising at least one blue-sensitive silver halide emulsion layer having associated therewith at least one yellow dye-forming coupler, wherein the ultraviolet filter layer is coated above at least the blue-sensitive silver halide emulsion layer. The element can contain additional layers, such as filter layers, interlayers, overcoat layers, and subbing layers. It is further preferred that the color silver halide elements are negative working silver halide elements. It is also preferred that the silver halide photographic elements are capture or origination elements such a color negative film or a motion picture origination film.

In a particular embodiment of the invention, the use of ultraviolet absorbing dibenzoylmethane compounds of formula (I) in a multi-layer color photographic element advantageously enables the blue spectral sensitivity curve for the element to have a height at 400 nm which is at least 63% of the maximum blue spectral sensitivity, and wherein the area under the blue spectral sensitivity curve for wavelengths above 420 nm is at least 66% of the total area under the curve for wavelengths above 360 nm. Such combination of relatively high sensitivity at 400 nm and relatively high percentage of overall blue sensitivity being accounted for by wavelengths above 420 nm has been found to provide the desired high blue sensitivity in combination with minimal impact on color reproduction characteristics for multi-layer color photographic elements in accordance with the present invention.

While compounds of Formula (I) have been found to advantageously provide a desired sharp cut absorption, they have also been observed to provide less than desired absorption over substantial portions of the UV spectrum below 360 nm. In particular, while the ultraviolet absorbers of the Formula I have steeply rising transmittance curves at a wavelength of approx. 390 to 400 nm, the ultraviolet absorber may not sufficiently absorb light in a portion of the ultraviolet region (e.g., in the region of not longer than 350 nm, generally approx. 250 nm to approx. 350 nm, especially in the region in the vicinity of 300 nm). In order to provide both a sharp cut off in absorption between the UV and visible light spectral regions, as well as increased absorbance across more of the UV spectrum, a second UV absorbing compound is accordingly preferably employed in the ultraviolet filter layer in combination with the primary dibenzoylmethane compound, which second ultraviolet absorbing compound is selected to provide absorption of light at wavelengths below 360 nm for which the compound of Formula I is deficient at absorbing, while transmitting visible light. The second ultraviolet light absorbing compound may comprise, e.g., a cyanoester, cyanosulfone, cyanoacrylate, hydroxyphenyl-s-triazine, hydroxyphenylbenzotriazole, formamidine, benzophenone, or benzoxazinone compound. In a particular contemplated embodiment, e.g., the second ultraviolet light absorbing compound may comprise a cyanoester or cyanosulfone as described in U.S. Pat. No. 6,143,484, the disclosure of which is hereby incorporated by reference. Additional possible UV absorbers which may be employed include salicylate compounds, such as 4-t-butylphenylsalicylate; and [2,2'thiobis-(4-toctylphenolate)]n-butylamine nickel(II). Such ultraviolet light absorbing compounds are themselves known, and have been described for use in various polymeric elements. Preferred are cyanoester, cyanosulfone, cyanoacrylate, hydroxyphenyl-s-triazine and hydroxyphenylbenzotriazole compounds, including those compounds disclosed in the references incorporated by reference above.

In the following discussion of suitable materials for use in the emulsions and elements of this invention, reference will be made to Research Disclosure, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e., color negative, reversal, or direct positive processing) provided with the element. More preferably the elements are negative working. Suitable emulsions and their preparation, as well as methods of chemical and spectral sensitization, are described in Sections I through V. Various additives such as UV dyes, brighteners, antifoggants, stabilizers, light absorbing and scattering materials, and physical property modifying addenda such as hardeners, coating aids, plasticizers, lubricants, and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in Research Disclosure, Item 37038, February 1995.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,333,999; and 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309; and 4,540,654, and "Farbkupplereine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443; 2,407,210; 2,875,057; 3,048,194; 3,265,506; 3,447,928; 4,022,620; 4,443,536; and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345; 3,928,041; 3,958,993; and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or maminophenols that form black or neutral products on reaction with oxidized color developing agent.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169; 3,227,551; 3,432,521; 3,476,563; 3,617,291; 3,880,661; 4,052,212; and 4,134,766; and in U.K. Patents and published application Nos. 1,466,728, 1,531,927, 1,533,039, 2,006,755A and 2,017,704A.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628; 5,151,343; and 5,234,800.

It may be useful to use a combination of couplers any of which may contain known ballasts or coupling-off groups such as those described in U.S. Pat. Nos. 4,301,235; 4,853,319; and 4,351,897. The coupler may contain solubilizing groups such as described in U.S. Pat. No. 4,482,629. The coupler may also be used in association with "wrong" colored couplers (e.g., to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193,389; EP 301,477; and U.S. Pat. Nos. 4,163,669; 4,865,956; and 4,923,784 may be useful. Also contemplated is use of the compositions in association with nucleating agents, development accelerators or their precursors (UK Patents 2,097,140 and 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g., as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (diR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362, 878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor Releasing (diR) Couplers for Color Photography," C. R. Barr, J. R. Thirtle and P. W. Vittum in *Photographic Science and Engineering* Vol. 13, p. 174 (1969), incorporated herein by reference. Generally, the developer inhibitor-releasing (diR) couplers include a coupler moiety and an inhibitor coupling-off moiety (IN). The inhibitor-releasing couplers may be of the time-delayed type (diAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

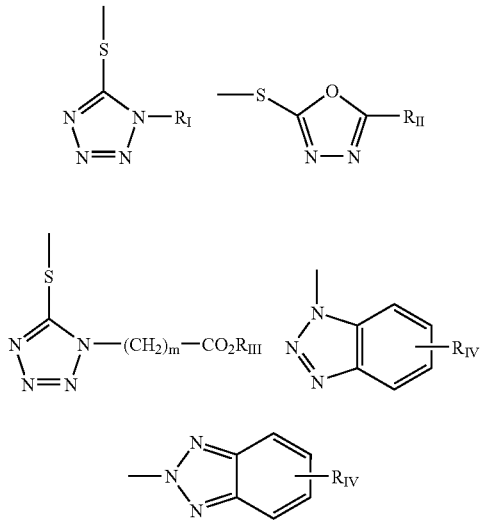

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; and 4,861,701, Japanese Applications 57-188035; 58-98728; 58-209736; 58-209738); groups that function as a coupler or reducing agent after the coupler reaction (U.S. Pat. Nos. 4,438,193 and 4,618,571) and groups that combine the features described above.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148, and 60-249149.

Suitable developer inhibitor-releasing couplers for use in the present invention include, but are not limited to, the following:

D1

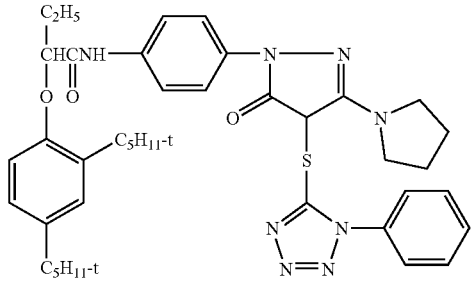

D2

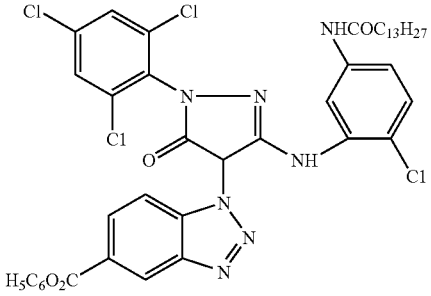

-continued
D3
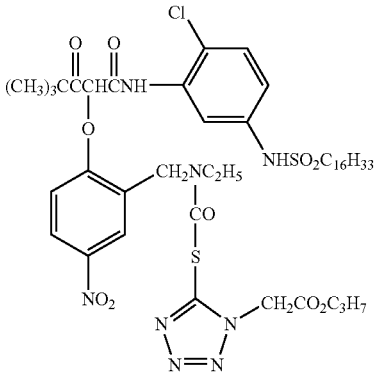
D4
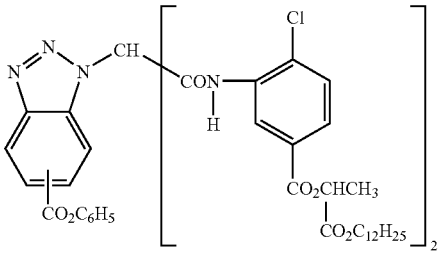
D5
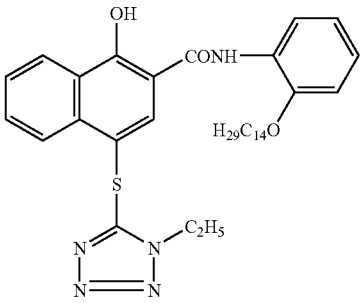
D6
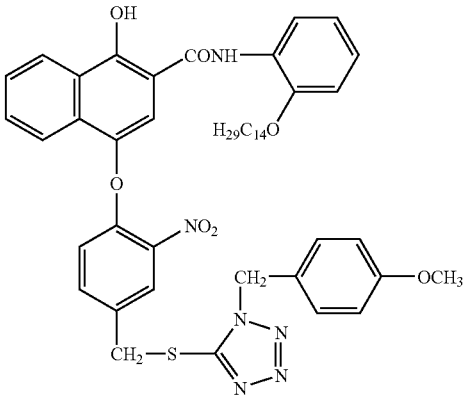
-continued
D7
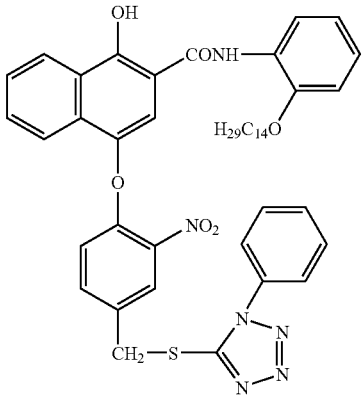
D8
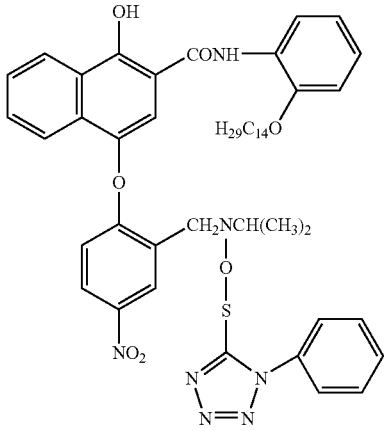
D9
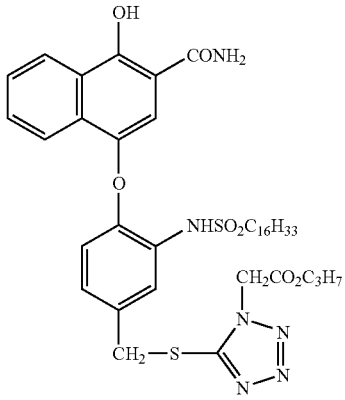

-continued

D10

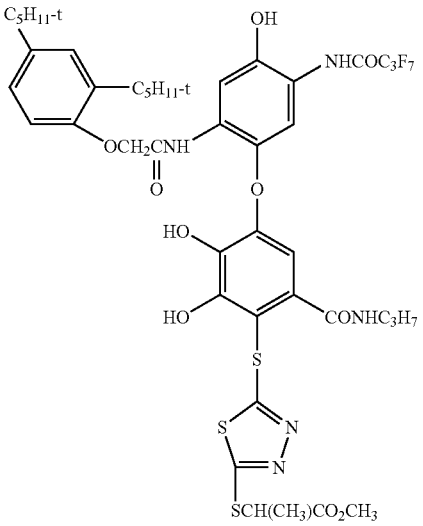

D11

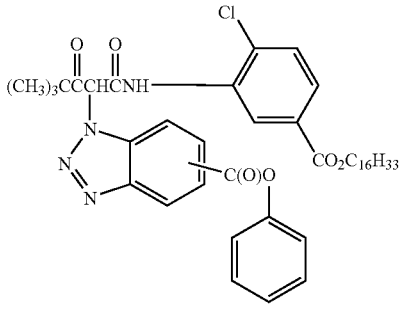

D12

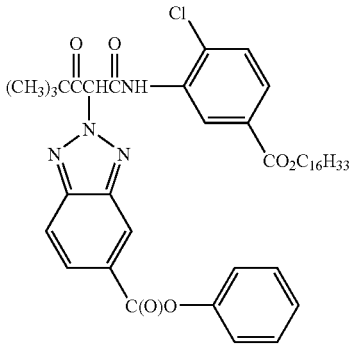

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)-hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1 oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, ptolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-tpentylphenoxy)butyl]carbamoyl, N-methyl-N-tetradecylcarbamoyl, and N,N-dioctylcarbamoyl; acyl, such as acetyl, (2,4-di-t-amylphenoxy) acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di -t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The silver halide used in the photographic elements may be silver iodobromide, silver bromide, silver chloride, silver chlorobromide, and silver chloroiodobromide. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, and pH values at suitable values during formation of the silver halide by precipitation.

Especially useful in light-sensitive layers of elements of this invention are radiation-sensitive tabular grain silver halide emulsions, alone as well as in combination with conventional non-tabular grain emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by Maskasky U.S. Pat. Nos. 5,508,160 and 5,512,427 and Delton U.S. Pat. Nos. 5,372,927 and 5,460,934.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually preferred to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide, and silver iodobromochloride tabular grain emulsions.

When tabular grain emulsions are spectrally sensitized, as herein contemplated, it is preferred to limit the average thickness of the tabular grains to less than 0.3 μm. Most preferably the average thickness of the tabular grains is less than 0.2 μm. In a specific form the tabular grains may be ultrathin—that is, their average thickness is less than 0.07 μm.

The useful average grain ECD of a tabular grain emulsion can range up to about 15 μm. Except for a very few high speed applications, the average grain ECD of a tabular grain emulsion is conventionally less than 10 μm, with the average grain ECD for most tabular grain emulsions being less than 5 μm.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by Wey U.S. Pat. No. 4,399,215; Wey et al U.S. Pat. No. 4,414,306; Maskasky U.S. Pat. Nos. 4,400,463; 4,713,323; 5,061,617; 5,178,997; 5,183,732; 5,185,239; 5,399,478; and 5,411,852; Maskasky et al U.S. Pat. Nos. 5,176,992 and 5,178,998, Takada et al U.S. Pat. No. 4,783,398; Nishikawa et al U.S. Pat. No. 4,952,508; Ishiguro et al U.S. Pat. No. 4,983,508; Tufano et al U.S. Pat. No. 4,804,621; Maskasky and Chang U.S. Pat. No. 5,178,998; and Chang et al U.S. Pat. No. 5,252,452. Ultrathin high chloride {111} tabular grain emulsions are illustrated by Maskasky U.S. Pat. Nos. 5,271,858 and 5,389,509. Since silver chloride grains are most stable in terms of crystal shape with {100 } crystal faces, it is common practice to employ one or more grain growth modifiers during the formation of high chloride {111} tabular grain emulsions. Typically the grain growth modifier is displaced prior to or during subsequent spectral sensitization, as illustrated by Jones et al U.S. Pat. No. 5,176,991 and Maskasky U.S. Pat. Nos. 5,176,992; 5,221,602; 5,298,387; and 5,298,388.

Preferred high chloride tabular grain emulsions are {100} tabular grain emulsions, as illustrated by the following patents: Maskasky U.S. Pat. Nos. 5,264,337; 5,292,632; 5,275,930; 5,607,828; and 5,399,477; House et al U.S. Pat. No. 5,320,938; Brust et al U.S. Pat. No. 5,314,798; Szajewski et al U.S. Pat. No. 5,356,764; Chang et al U.S. Pat. Nos. 5,413,904; 5,663,041; and 5,744,297; Budz et al U.S. Pat. No. 5,451,490; Reed et al U.S. Pat. No. 5,695,922; Oyamada U.S. Pat. No. 5,593,821; Yamashita et al U.S. Pat. Nos. 5,641,620 and 5,652,088, Saitou et al U.S. Pat. No. 5,652,089; and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520; Wilgus et al U.S. Pat. No. 4,434,226; Solberg et al U.S. Pat. No. 4,433,048; Maskasky U.S. Pat. Nos. 4,435,501; 4,463,087; 4,173,320; and 5,411,851; 5,418,125; 5,492,801; 5,604,085; 5,620,840; 5,693,459; 5,733,718; Daubendiek et al U.S. Pat. Nos. 4,414,310 and 4,914,014; Sowinski et al U.S. Pat. No. 4,656,122; Piggin et al U.S. Pat. Nos. 5,061,616 and 5,061,609; Tsaur et al U.S. Pat. Nos. 5,147,771; '772; '773; 5,171,659; and 5,252,453; Black et al U.S. Pat. Nos. 5,219,720 and 5,334,495; Delton U.S. Pat. Nos. 5,310,644; 5,372,927; and 5,460,934; Wen U.S. Pat. No. 5,470,698; Fenton et al U.S. Pat. No. 5,476,760; Eshelman et al U.S. Pat. Nos. 5,612,175; 5,612,176; and 5,614,359; and Irving et al U.S. Pat. Nos. 5,695,923; 5,728,515; and 5,667,954; Bell et al U.S. Pat. No. 5,132,203; Brust U.S. Pat. Nos. 5,248,587; and 5,763,151; Chaffee et al U.S. Pat. No. 5,358,840; Deaton et al U.S. Pat. No. 5,726,007; King et al U.S. Pat. No. 5,518,872; Levy et al U.S. Pat. No. 5,612,177; Mignot et al U.S. Pat. No. 5,484,697; Olm et al U.S. Pat. No. 5,576,172; and Reed et al U.S. Pat. Nos. 5,604,086 and 5,698,387.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al U.S. Pat. No. 5,726,006.

In many of the patents listed above (starting with Kofron et al, Wilgus et al, and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. For example, Fenton et al U.S. Pat. No. 5,476,76 discloses lower iodide concentrations at the corners of the tabular grains than elsewhere along their edges. Jagannathan et al U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al, and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in Research Disclosure, Item 38957, Section I. Emulsion grains and their preparation, sub-section G. Grain modifying conditions and adjustments, paragraphs (3), (4) and (5), can be present in the emulsions of the invention. Especially useful dopants are disclosed by Marchetti et al U.S. Pat. No. 4,937,180; and Johnson et al U.S. Pat. No. 5,164,292. In addition, it is specifically contemplated to dope the grains with transition metal hexacoordination complexes containing one or more organic ligands, as taught by Olm et al U.S. Pat. No. 5,360,712.

It is specifically contemplated to incorporate in the face centered cubic crystal lattice of the grains a dopant capable of increasing imaging speed by forming a shallow electron trap (hereinafter also referred to as a SET) as discussed in *Research Disclosure*, Item 36736, published November 1994. SET dopants are known to be effective to reduce reciprocity failure. In particular the use of $Ir^{+3}$ or $Ir^{+4}$ hexacoordination complexes as SET dopants is advantageous. Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al U.S. Pat. No. 4,933,272.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al U.S. Pat. No. 4,504,570.

It is specifically contemplated to employ a blue light recording unit in the photographic elements of the invention which comprises high bromide tabular grain photographic emulsions sensitized with combinations of blue light sensitizing dyes providing sensitivity peaks both above and below 450 nm, such as described in U.S. Pat. Nos. 5,474,887 and 5,460,928, the disclosures of which are incorporated by reference herein. Such emulsions are further preferably employed in combination with conventional "3-D" non-tabular grain high bromide emulsions which exhibit native sensitivity in the short blue (i.e., below 430 nm) region. In such specific embodiments, such non-tabular grain emulsions may or may not be spectrally sensitized with dyes providing peak sensitizations above and/or below 450 nm. Further contemplated blue sensitization schemes for use in elements in accordance with the invention include those described in U.S. Pat. Nos. 6,225,037, 6,509,144, 6,815,153, and 6,811,963, the disclosures of which are also incorporated by reference herein.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in *The British Journal of photography Annual* of 1988, pages 191-198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "one time use camera", "single use cameras", "lens with film", or "photosensitive material package units".

If desired, the photographic element can be used in conjunction with an applied magnetic layer as described in Research Disclosure, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, Research Disclosure, June 1994, Item 36230, provides suitable embodiments. A particularly useful support for small format film is annealed polyethylenenaphthlate.

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing to remove silver or silver halide, washing, and drying.

The entire contents of the patents and other publications cited in this specification are incorporated herein by reference. The following examples are intended to illustrate, but not to limit the invention:

EXAMPLES

Example 1

112.5 g of UV Dye-1 and 112.5 g of UV Dye-2 and 22.5 g of Chem-1 was dissolved in 157.5 g of tri-cresyl phosphate. This oil phase solution was then added to an aqueous phase solution consisting of 300.0 g Type IV gelatin, 180.0 g of a 10 wt % solution of Alkanol XC (Dupont), 4.3 g of a 0.7 wt % solution of Kathon LX (Rohm & Haas), 36.0 g of 9.24 wt % sulfuric acid and 2074.7 g of distilled water. This mixture was pre-mixed using a Brinkman rotor-stator device at 5000 rpm for 2 min at 80° C. and then passed one time through a Crepaco homogenizer at 5000 psi at 80° C. to form Dispersion A, which consisted of 3.75% UV Dye-1 and 3.75% UV Dye-2 and 10.0% gel. Dispersion B was similarly prepared except that it employed 112.5 g UV Dye-3 in place of UV Dye-1.

Dispersion A was coated in Layers 1 and 12 of the multilayer film structure given below as Coating 1. Additional experimental coating variations are described in Table I.

MULTILAYER FILM STRUCTURE: COATING 1

| | mg/sq meter |
|---|---|
| Layer 1 | |
| Black colloidal silver | 150 |
| UV Dye-1 | 75 |
| UV Dye-2 | 75 |
| Dye-1 | 30 |
| Dye-2 | 25 |
| Dye-3 | 30 |
| Chem-1 | 15 |
| Chem-2 | 32 |
| Chem-3 | 125 |
| Gelatin | 2400 |

-continued

MULTILAYER FILM STRUCTURE: COATING 1

| | mg/sq meter |
|---|---|
| Layer 2 | |
| Tabular slow cyan emulsion (0.7 microns by 0.105 microns, $AgI_{.05}Br_{.95}$, dyed with sensitizing dye-1 and sensitizing dye-2) | 225 |
| Tabular slow-slow cyan emulsion (0.3 microns by 0.115 microns, $AgI_{.02}Br_{.98}$, dyed with sensitizing dye-1 and sensitizing dye-2) | 430 |
| Coup-1 | 300 |
| Coup-2 | 95 |
| Coup-3 | 78 |
| Coup-4 | 30 |
| Coup-5 | 24 |
| Gelatin | 1900 |
| Layer 3 | |
| Tabular mid cyan emulsion (1.2 microns by 0.12 microns, $AgI_{.05Br.95}$, dyed with sensitizing dye-1 and sensitizing dye-2) | 544 |
| Coup-1 | 200 |
| Coup-3 | 33 |
| Coup-4 | 40 |
| Coup-5 | 24 |
| Chem-2 | 30 |
| Gelatin | 1160 |
| Layer 4 | |
| Tabular fast cyan emulsion (2.0 microns by 0.13 microns, $AgI_{.05Br.95}$, dyed with sensitizing dye-1 and sensitizing dye-2) | 720 |
| Coup-1 | 70 |
| Coup-2 | 10 |
| Coup-3 | 18 |
| Coup-4 | 20 |
| Coup-5 | 8 |
| Coup-6 | 37 |
| Chem-2 | 65 |
| Gelatin | 1000 |
| Layer 5 | |
| Dye-4 | 46 |
| Chem-3 | 74 |
| Gelatin | 538 |
| Layer 6 | |
| Tabular slow magenta emulsion (0.8 microns by 0.11 microns, $AgI_{.045}Br_{.955}$, dyed with sensitizing dye-3 and sensitizing dye-4) | 185 |
| Tabular slow-slow magenta emulsion (0.3 microns by 0.12 microns, 3.0% iodide, dyed with sensitizing dye-3 and sensitizing dye-4) | 175 |
| Coup-7 | 210 |
| Coup-8 | 140 |
| Coup-9 | 24 |
| Gelatin | 1250 |
| Layer 7 | |
| Tabular mid magenta emulsion (1.4 microns by 0.13 microns, $AgI_{.045}Br_{.955}$, dyed with sensitizing dye-3 and sensitizing dye-4) | 410 |
| Tabular slow magenta emulsion (0.8 microns by 0.11 microns, $AgI_{.045}Br_{.955}$, dyed with sensitizing dye-3 and sensitizing dye-4) | 100 |
| Coup-7 | 55 |
| Coup-8 | 115 |
| Coup-9 | 8 |
| Gelatin | 1100 |
| Layer 8 | |
| Tabular fast magenta emulsion (1.9 microns by 0.125 microns, $AgI_{.065}Br_{.935}$, dyed with sensitizing dye-3, sensitizing dye-4, and sensitizing dye-5) | 480 |
| Coup-7 | 60 |
| Coup-8 | 15 |

-continued

| MULTILAYER FILM STRUCTURE: COATING 1 | mg/sq meter |
|---|---|
| Coup-9 | 8 |
| Coup-10 | 16 |
| Chem-2 | 24 |
| Chem-3 | 20 |
| Gelatin | 1218 |
| Layer 9 | |
| Dye-4 | 54 |
| Chem-3 | 88 |
| Gelatin | 640 |
| Layer 10 | |
| Tabular mid yellow emulsion (1.8 microns by 0.13 microns, $AgI_{.03}Br_{.97}$, dyed with sensitizing dye-6 and sensitizing dye-7) | 260 |
| Tabular slow yellow emulsion (0.9 microns by 0.13 microns, $AgI_{.03}Br_{.97}$, dyed with sensitizing dye-6 and sensitizing dye-7) | 120 |
| Tabular slow-slow yellow emulsion (0.45 microns by 0.08 microns, $AgI_{.013}Br_{.987}$, dyed with sensitizing dye-6 and sensitizing dye-7) | 300 |
| Coup-2 | 5 |
| Coup-4 | 30 |
| Coup-11 | 1180 |
| Coup-12 | 90 |
| Coup-13 | 110 |
| Gelatin | 2400 |
| Layer 11 | |
| 3D fast yellow emulsion (1.2 microns, $AgI_{.10}Br_{.90}$, dyed with sensitizing dye-6) | 200 |
| Tabular slow-fast yellow emulsion (2.9 microns by 0.12 microns, $AgI_{.045}Br_{.955}$, dyed with sensitizing dye-6 and sensitizing dye-7) | 480 |
| Coup-2 | 5 |
| Coup-11 | 340 |
| Coup-12 | 50 |
| Coup-13 | 40 |
| Gelatin | 1100 |
| Layer 12 | |
| UV Dye-1 | 105 |
| UV Dye-2 | 105 |
| Chem-1 | 21 |
| Lippman emulsion | 215 |
| Gelatin | 690 |
| Layer 13 | |
| Gelatin | 867 |

The above coating further contains sequestrants, antifoggants, surfactants, antistat, matte beads, and lubricants as known in the art. The film also contains hardener at 1.8% of total gel.

UV dye-1

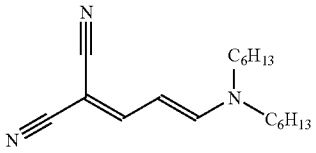

-continued

UV dye-2

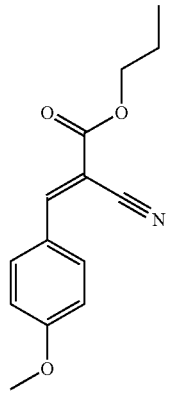

UV Dye-3

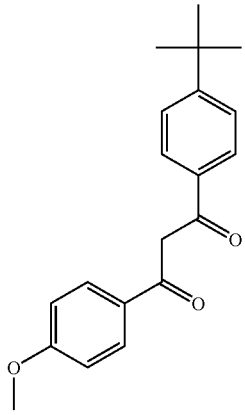

Dye-1

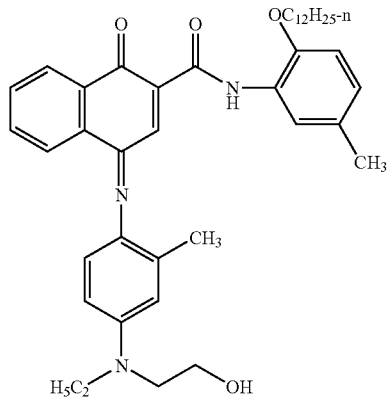

Dye-2

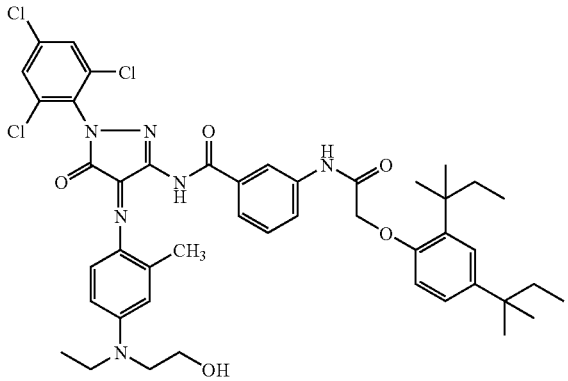

-continued
Dye-3
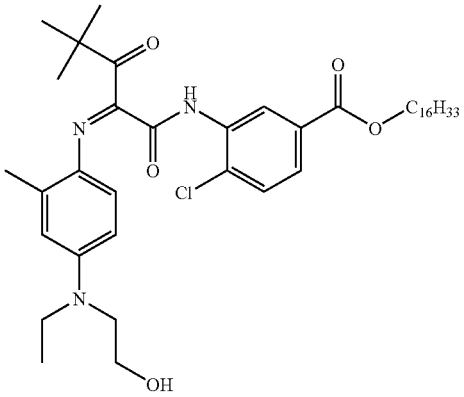
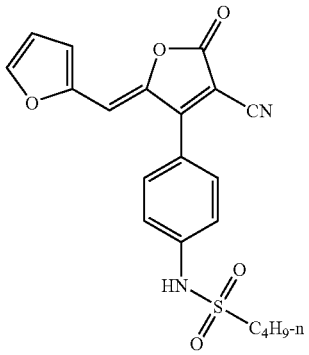
Chem-1
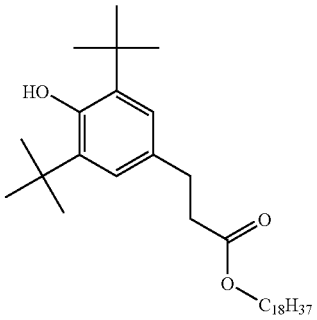
Chem-2
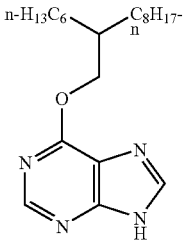
Chem-3
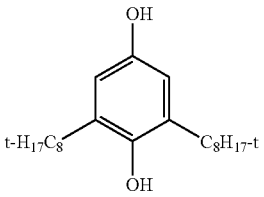
-continued
Sensitizing dye-1
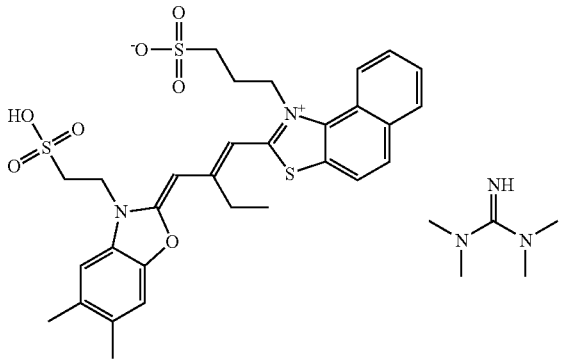
Sensitizing dye-2
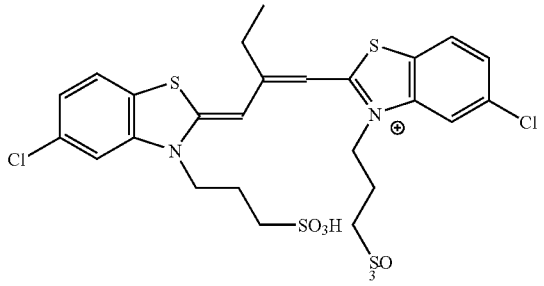
Sensitizing dye-3
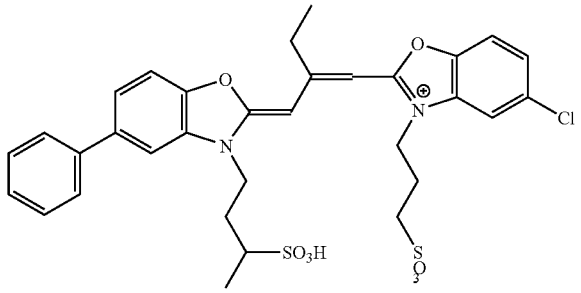
Sensitizing dye-4
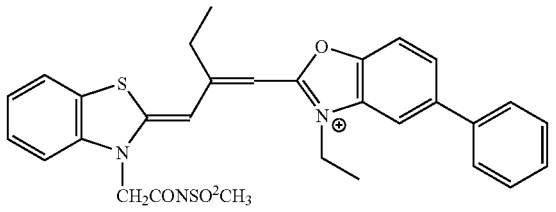
Sensitizing dye-5
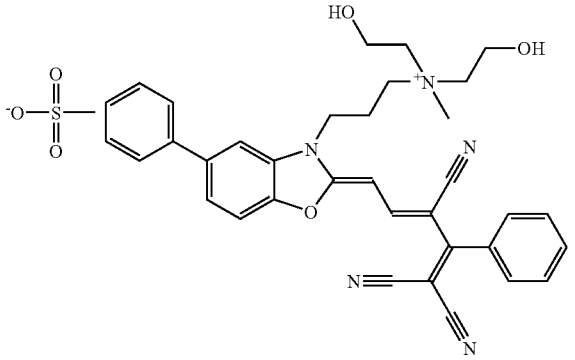

-continued
Sensitizing dye-6
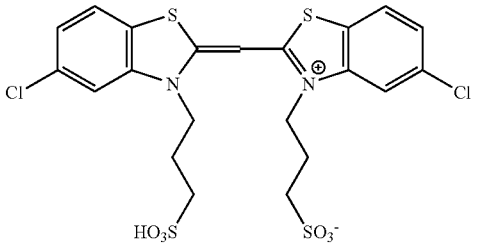
Sensitizing dye-7
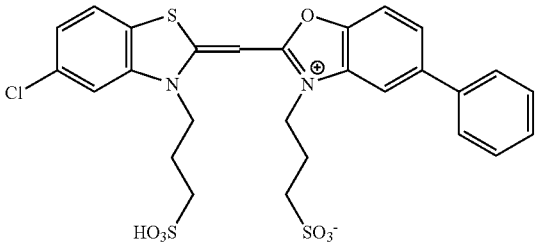
Coup-1
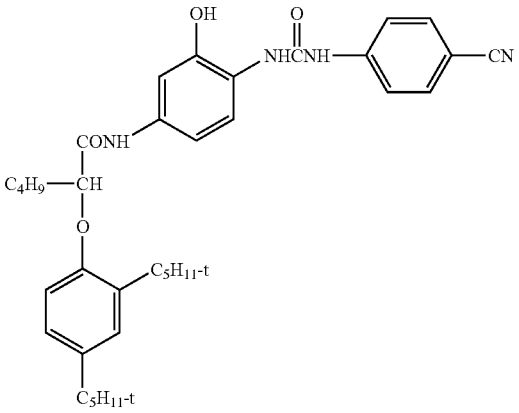
Coup-2
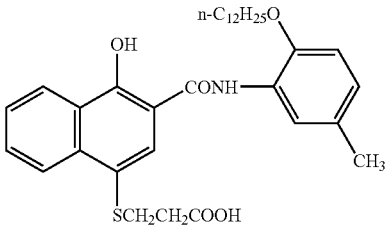
Coup-3
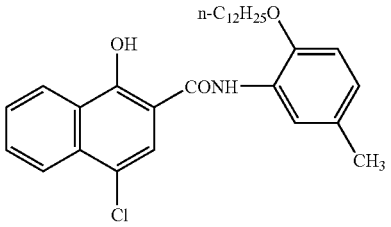
-continued
Coup-4
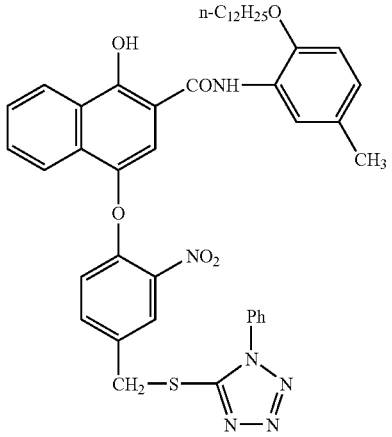
Coup-5
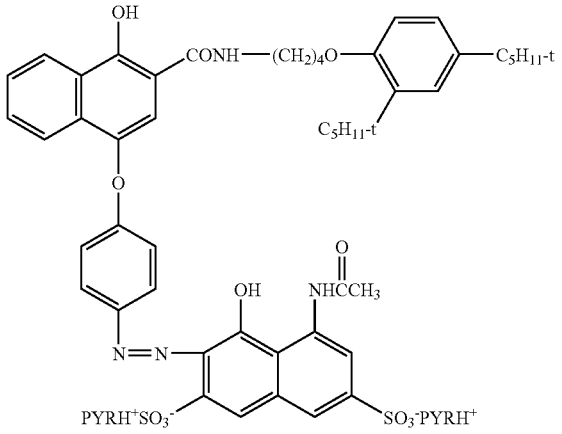
Coup-6
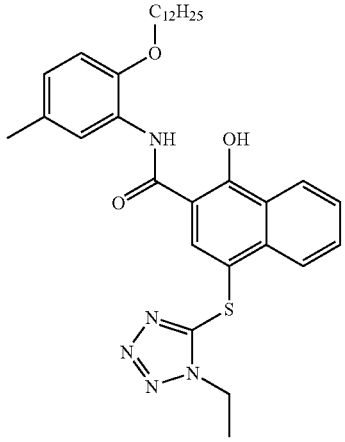

-continued
Coup-7
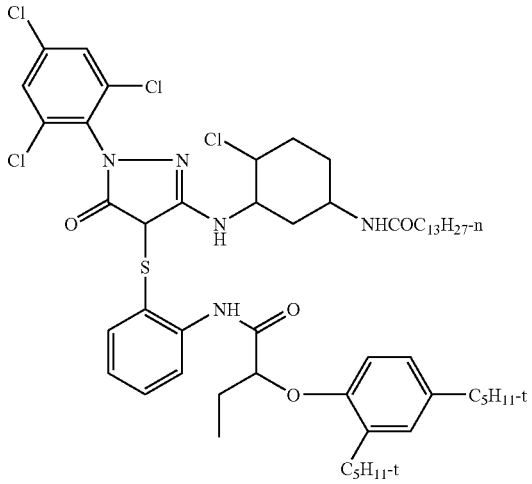
Coup-8
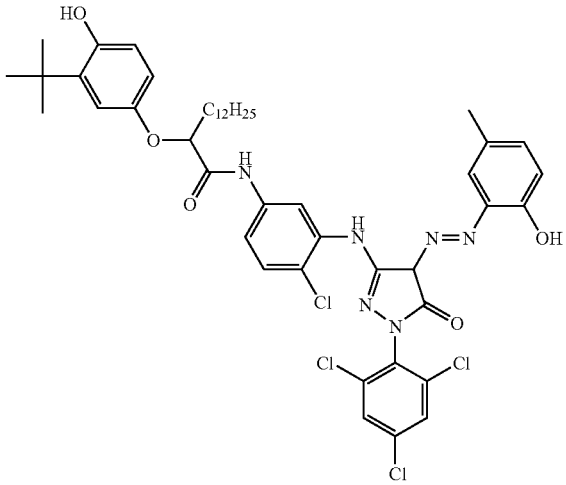
Coup-9
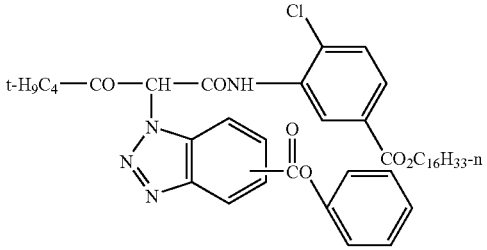
-continued
Coup-10
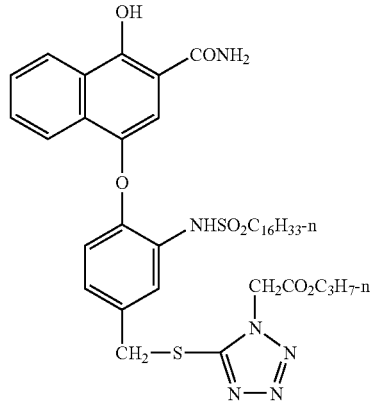
Coup-11
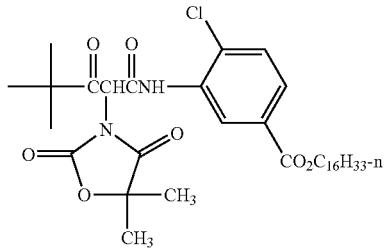
Coup-12
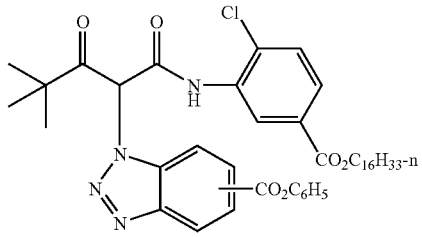
Coup-13
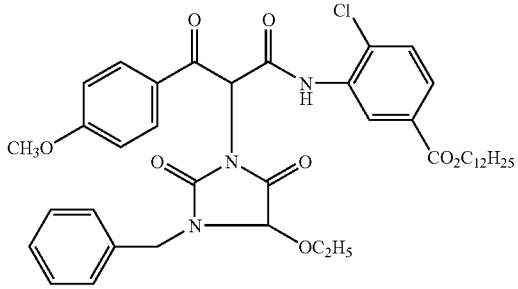

The elements were exposed with a tungsten filament lamp with a quartz envelope balanced to simulate daylight with a color temperature of 5000 K (1/100 sec, daylight 5A filter, 1.0 neutral density filter) through a 21 step, 0-4 Log Exposure neutral density step tablet. After exposure, the elements were processed using Kodak Flexicolor C-41 process as described in Brit. J. Photog. Annual, 1988, p 196–198 with the exception that the composition of the bleach solution was changed to comprise propylenediaminetetraacetic acid.

The optical density due to dye formation was then measured on a densitometer using filters in a densitometer appropriate to the intended use of the photographic element. Dye Density was then graphed vs. Log exposure to form the Red, Green, and Blue D-LogE characteristic curves of the photographic elements. The relative blue speeds at a density of 0.15 density units above the minimum density are listed in Table 1. The blue contrasts over steps 5 to 9 (of 21 steps) in the lower part of the curve are calculated using the least squares method and listed in Table 1.

TABLE I

Multilayer Color Negative Film Variations (coated levels in mg/m$^2$)

| Coating No | Dispersion ID | Short UV Dye | Long UV Dye | UV Dye Levels* | Blue Ag Levels** | Blue Speed | Blue Contrast |
|---|---|---|---|---|---|---|---|
| 1 (Comp) | A | UV Dye-2 | UV Dye-1 | 105 | 1360 | 339 | 0.665 |
| 2 (Inv) | B | UV Dye-2 | UV Dye-3 | 105 | 1360 | 347 | 0.688 |
| 3 (Inv) | B | UV Dye-2 | UV Dye-3 | 105 | 1268 | 343 | 0.676 |
| 4 (Comp) | A | UV Dye-2 | UV Dye-1 | 105 | 1360 | 339 | 0.665 |

*Layer 12 only
**Total blue-sensitive silver in Layers 10 and 11

Coating 2, in which a UV absorber of Formula (I) in accordance with the present invention (UV Dye-3) was substituted for UV Dye-1 in Layers 1 and 12, exhibits significantly increased blue speed and blue contrast relative to comparison Coatings 1 and 4. Coating 3, in which the UV absorber of the present invention (UV Dye-3) was substituted for UV Dye-1 and the blue-sensitive silver level was reduced, shows slightly increased blue speed and blue contrast relative to comparison Coatings 1 and 4, indicating that even greater silver level reductions are enabled by the present invention. The 92 mg/m$^2$ reduction in blue-sensitive silver was attained by removing 117 mg/m2 from layer 11 and adding 25 mg/m2 to layer 10 to maintain a linear curve shape. Coatings 2 and 3 exhibited no adverse effects on color reproduction.

Example 2

Comparison Coating 1 of Example 1 exhibits a blue spectral sensitivity that is typical of commercially available films, as illustrated in FIG. 1. This blue spectral sensitivity has a height at 400 nm which is approximately 24 percent of the maximum blue spectral sensitivity, while the area under the blue spectral sensitivity curve for wavelengths above 420 nm is approximately 79 percent of the total area under the curve for wavelengths above 360 nm. While other commercially available films may provide higher relative sensitivity at 400 nm, those that do will also generally provide significantly lower percentages of overall blue sensitivity accounted for by wavelengths above 420 nm, and no commercially available element is known which provides a blue spectral sensitivity curve for the element having a height at 400 nm which is at least 63% of the maximum blue spectral sensitivity, and wherein the area under the blue spectral sensitivity curve for wavelengths above 420 nm is at least 66% of the total area under the curve for wavelengths above 360 nm.

Coating 3 of Example 1, employing a UV absorbing compound in accordance with the present invention, on the other hand, exhibits a blue spectral sensitivity having a height at 400 nm which is 68 percent of the maximum blue spectral sensitivity, while the area under the blue spectral sensitivity curve for wavelengths above 420 nm is 69 percent of the total area under the curve for wavelengths above 360 nm. Thus, both the sensitivity at 400 nm and the percentage of overall blue sensitivity accounted for by wavelengths above 420 nm are high.

Coatings 1 and 3 were normally exposed under identical capture conditions using an analytical target comprising 240 patches. The patches in the analytical target were nearly equally distributed in CIELAB space. The two films were processed at the same time in a C41 seasoned process. The resulting negative images were printed onto the same photographic paper and the prints from both films were balanced such that a reference mid-scale neutral was reproduced at CIELAB coordinates that were within 1 Delta E* of the original color (51.5, −0.15, −0.60). The reflectance spectrum of the each color patch was measured with a spectrophotometer, and then CIELAB coordinates calculated for all spectra using CIE D50 and the CIE 2-degree observer. In making these films, the blue silver levels of Coating 3 were adjusted such that the speed and neutral curve shape of Coating 3 matched those of Coating 1. The red and green spectral sensitivities of Coating 3 also match the respective sensitivities of Coating 1, and the magnitude and type of the interlayer interimage effects were identical in both films. Therefore, all actual color reproduction differences between Coating 1 and Coating 3 should be due solely to differences in their blue spectral sensitivities. Since there was always a small balancing deviation from the reference CIELAB aim during the printing step, however, the calculated CIELAB values were mathematically adjusted to account for the balancing deviations of the reference patch. In this manner, the calculated color differences due to print-balancing deviations were separated from those differences due to spectral sensititvity differences. The CIEDE2000 color differences between the patches reproduced with Coating 1 and those reproduced with Coating 3 were found to have a mean of 0.9 and a standard deviation of 0.7. Therefore, the color differences due to spectral sensitivity differences between Coating 1 and Coating 3 were very small for most colors. Images with pictorial content (people, sky, plants, buildings, etc.) were then generated, and it was visually confirmed that the prints produced with Coating 3 looked very similar to those produced with Coating 1.

Example 3

Dispersions C and D were prepared with the same formulation as Dispersions A and B, respectively. These dispersions were coated in Layers 1 and 12 of the multilayer film structure given above as described in Table II.

TABLE II

Multilayer Color Negative Film Variations (coated levels in mg/m$^2$)

| Coating No | Dispersion ID | Short UV Dye | Long UV Dye | UV Dye Levels* | Blue Ag Levels | Blue Speed | Blue Contrast |
|---|---|---|---|---|---|---|---|
| 5 (Comp) | C | UV Dye-2 | UV Dye-1 | 105 | 1360 | 340 | 0.675 |
| 6 (Comp) | C | UV Dye-2 | UV Dye-1 | 105 | 1360 | 340 | 0.674 |

TABLE II-continued

Multilayer Color Negative Film Variations (coated levels in mg/m$^2$)

| Coating No | Dispersion ID | Short UV Dye | Long UV Dye | UV Dye Levels* | Blue Ag Levels | Blue Speed | Blue Contrast |
|---|---|---|---|---|---|---|---|
| 7 (Inv) | D | UV Dye-2 | UV Dye-3 | 105 | 1360 | 347 | 0.700 |
| 8 (Comp) | C | UV Dye-2 | UV Dye-1 | 105 | 1360 | 340 | 0.675 |

*Layer 12 only

Coating 7, in which the UV absorber of the present invention (UV Dye-3) was substituted for UV Dye-1, exhibits significantly increased blue speed and blue contrast relative to comparison Coatings 5, 6 and 8, with no significant adverse effects on color reproduction.

Example 4

Dispersions E and F were also prepared with the same formulation as Dispersions A and B, respectively. Dispersion G was also similarly prepared, except the long UV dye component (UV dye 1) was omitted. These dispersions were coated in Layers 1 and 12 of the multilayer film structure given above as described in Table III.

TABLE III

Multilayer Color Negative Film Variations (coated levels in mg/m$^2$)

| Coating No | Dispersion ID | Short UV Dye | Long UV Dye | UV Dye Levels* | Blue Ag Levels** | Blue Speed | Blue Contrast |
|---|---|---|---|---|---|---|---|
| 9 (Comp) | E | UV Dye-2 | UV Dye-1 | 105 | 1360 | 339 | 0.617 |
| 10 (Comp) | G | UV Dye-2 | — | 105 | 1360 | 350 | 0.628 |
| 11 (Inv) | F | UV Dye-2 | UV Dye-3 | 121 | 1250 | 341 | 0.612 |
| 12 (Inv) | F | UV Dye-2 | UV Dye-3 | 105 | 1250 | 341 | 0.609 |
| 13 (Comp) | E | UV Dye-2 | UV Dye-1 | 105 | 1360 | 339 | 0.617 |

*Layer 12 only
**Total blue-sensitive silver in Layers 10 and 11

Coating 10, which contains no long wavelength absorbing UV dye, shows a substantial increase in blue speed. However, color modeling studies showed that this coating had poor color reproduction quality. Coatings 11 and 12, which employ the UV absorber of the present invention (UV Dye-3) instead of UV Dye-1, exhibit approximately matched blue speed and blue contrast with substantially lower blue silver levels compared to comparison Coatings 9 and 13, again with no significant adverse effects on color reproduction. The 110 mg/m$^2$ reduction in blue-sensitive silver was attained by removing 125 mg/m$^2$ from layer 11 and adding 15 mg/m$^2$ to layer 10 to maintain a linear curve shape.

The invention has been described in detail with particular reference to certain preferred embodiments thereof, but it will be understood that variations and modifications can be effected within the spirit and scope of the invention.

The invention claimed is:

1. A photographic element comprising a support bearing at least one light sensitive silver halide emulsion layer and an ultraviolet filter layer above the light sensitive layer, wherein the ultraviolet filter layer comprises an ultraviolet absorbing dibenzoylmethane compound of formula (I)

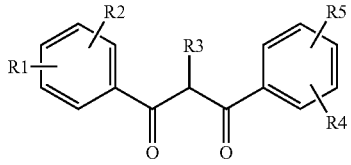

where R1 through R5 are each independently hydrogen, halogen, nitro, or hydroyxl, or further substituted or unsubstituted alkyl, alkenyl, aryl, alkoxy, acyloxy, ester, carboxyl, alkyl thio, aryl thio, alkyl amine, aryl amine, alkyl nitrile, aryl nitrile, arylsulfonyl, or 5-6 member heterocycle ring groups.

2. A photographic element according to claim 1, comprising a red light recording unit comprised of at least one red-sensitive silver halide emulsion layer having associated therewith at least one cyan dye-forming coupler, a green light recording unit comprising at least one green-sensitive silver halide emulsion layer having associated therewith at least one magenta dye-forming coupler, and a blue light recording unit comprising at least one blue-sensitive silver halide emulsion layer having associated therewith at least one yellow dye-forming coupler, wherein the ultraviolet filter layer is coated above at least the bluesensitive silver halide emulsion layer.

3. A photographic element according to claim 2, wherein the blue spectral sensitivity curve for the element has a height at 400 nm which is at least 63% of the maximum blue spectral sensitivity, and wherein the area under the blue spectral sensitivity curve for wavelengths above 420 nm is at least 66% of the total area under the curve for wavelengths above 360 nm.

4. A photographic element according to claim 3, wherein the blue light recording unit comprises high bromide tabular grain silver halide emulsions sensitized with blue light sensitizing dyes, in combination with non-tabular grain high bromide silver halide emulsions.

5. A photographic element according to claim 1, further comprising a second ultraviolet light absorbing compound in the ultraviolet filter layer which absorbs ultraviolet light at wavelengths below 360 nm for which the compound of formula I is deficient at absorbing.

6. A photographic element according to claim 5, wherein the second ultraviolet light absorbing compound comprises a cyanoester, cyanosulfone, cyanoacrylate, hydroxyphenyl-s-triazine, hydroxyphenylbenzotriazole, formamidine, benzophenone, or benzoxazinone compound.

7. A photographic element according to claim 1, wherein the ultraviolet absorbing dibenzoylmethane compound is of Formula I-A:

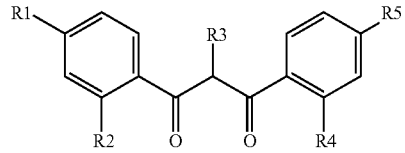

where R1 and R5 represent alkyl or alkoxy groups of from 1-6 carbon atoms and R2 through R4 represent hydrogen atoms.

* * * * *